US005956070A

United States Patent [19]

Paoli et al.

[11] Patent Number: 5,956,070

[45] **Date of Patent: *Sep. 21, 1999**

[54] COLOR XEROGRAPHIC PRINTER WITH MULTIPLE LINEAR ARRAYS OF SURFACE EMITTING LASERS WITH DISSIMILAR POLARIZATION STATES AND DISSIMILAR WAVELENGTHS

[75] Inventors: Thomas L. Paoli, Los Altos; Tibor Fisli, Los Altos Hills, both of Calif.

[73] Assignee: Xerox Corporation, Stamford, Conn.

[ * ] Notice: This patent is subject to a terminal disclaimer.

[21] Appl. No.: 08/577,792

[22] Filed: Dec. 22, 1995

[51] Int. Cl.[6] ..... B41J 2/47

[52] U.S. Cl. ..... 347/241; 347/239

[58] Field of Search ..... 347/241, 232, 347/256, 239; 250/236; 359/204, 621

[56] References Cited

U.S. PATENT DOCUMENTS

| | | | |
|---|---|---|---|
| 5,276,463 | 1/1994 | Andrews | 346/108 |
| 5,357,106 | 10/1994 | Wilson | 250/236 |
| 5,371,526 | 12/1994 | Appel et al. | 346/108 |
| 5,526,182 | 6/1996 | Jewell et al. | 359/621 |
| 5,563,647 | 10/1996 | Fisli | 347/232 |

*Primary Examiner*—N. Le
*Assistant Examiner*—Thinh Nguyen
*Attorney, Agent, or Firm*—William Propp

[57] ABSTRACT

A color printer uses multiple linear arrays of surface emitting lasers of differing wavelengths and polarization states to simultaneously expose widely separated positions on the same or different photoreceptors. Each array is imaged by the same optical system to the photoreceptor. The multiple linear arrays can be closely spaced in a monolithic structure.

22 Claims, 11 Drawing Sheets

COLOR XEROGRAPHIC PRINTER WITH MULTIPLE LINEAR ARRAYS OF SURFACE EMITTING LASERS WITH DISSIMILAR POLARIZATION STATES AND DISSIMILAR WAVELENGTHS

CROSS-REFERENCE TO RELATED APPLICATIONS

This application contains subject matter that is related to subject matter of:

(1) U.S. patent application Ser. No. 08/577,793 entitled "COLOR XEROGRAPHIC PRINTER WITH MULTIPLE LINEAR ARRAYS OF SURFACE EMITTING LASERS WITH THE SAME WAVELENGTHS", filed concurrently with this application, commonly assigned to the same assignee herein and herein incorporated by reference, (2) U.S. patent application Ser. No. 08/577,794 entitled "COLOR XEROGRAPHIC PRINTER WITH MULTIPLE LINEAR ARRAYS OF SURFACE EMITTING LASERS WITH DISSIMILAR WAVELENGTHS", filed concurrently with this application, commonly assigned to the same assignee herein and herein incorporated by reference, and (3) U.S. patent application Ser. No. 08/577,791 entitled "INCREASED PIXEL DENSITY AND INCREASED OPTICAL THROUGHPUT IN A XEROGRAPHIC PRINTER WITH MULTIPLE LINEAR ARRAYS OF SURFACE EMITTING LASERS", filed concurrently with this application, commonly assigned to the same assignee herein and herein incorporated by reference.

BACKGROUND OF THE INVENTION

This invention relates to a color xerographic printer and, more particularly, to a color xerographic printer with a monolithic structure of multiple linear arrays of surface emitting lasers with dissimilar polarization states and dissimilar wavelengths to simultaneously expose widely separated positions on the same or different photoreceptors.

A Raster Output Scanner (ROS) or a Light Emitting Diode (LED) print bar, known as imagers, used in xerographic printers are well known in the art. The ROS or the LED print bar is positioned in an optical scan system to write an image on the surface of a moving photoreceptor belt.

In a ROS system, a modulated beam is directed onto the facets of a rotating polygon mirror which then sweeps the reflected beam across the photoreceptor surface. Each sweep exposes a raster line to a linear segment of a video signal image.

However, the use of a rotating polygon mirror presents several inherent problems. Bow and wobble of the beam scanning across the photoreceptor surface result from imperfections in the mirror or even slight misangling of the mirror or from the instability of the rotation of the polygon mirror. These problems typically require complex, precise and expensive optical elements between the light source and the rotating polygon mirror and between the rotating polygon mirror and the photoreceptor surface. Additionally, optically complex elements are also needed to compensate for refractive index dispersion that causes changes in the focal length of the imaging optics of the ROS.

The LED print bar generally consists of a linear array of light emitting diodes. Each LED in the linear array is used to expose a corresponding area on a moving photoreceptor in response to the video data information applied to the drive circuits of the print bars. The photoreceptor is advanced in the process direction to provide a desired image by the formation of sequential scan lines.

In a color xerographic printer, a plurality of the light emitting elements of the LED print bars are imaged to a photoreceptor surface usually by closely spaced radially indexed glass fibers known as "selfoc" lenses.

Printing with LED bars requires a precisely fabricated "selfoc" lens for each light emitting element. Each "selfoc" lens array must be straight and parallel with highly polished input and output facets. Each lens within the array must have the same focal length and throughput efficiency. Even if these requirements are met, the "selfoc" lenses have short focal lengths and therefore must be positioned close to the photoreceptor surface where the lenses can collect toner and thereby require an additional cleaning mechanism. Due to their optical characteristics, the depth of focus of a "selfoc" lens is very short and consequently requires very precise placement to produce uniform spot exposures on the scan line.

Light emitting diodes, by their very nature, have a large angular divergence, a broad spectrum and are unpolarized, all factors which severely limit their use in color printing systems using a wavelength or polarization based scan line separation technique. Prior LED print bar xerographic line printers have taught only line exposure at a single position on one photoreceptor.

U.S. Pat. No. 5,337,074, commonly assigned as the present application and herein incorporated by reference, and U.S. Pat. No. 5,461,413 teach using a single linear surface emitting laser array as the light source for a line printer.

A laser array has a smaller angular beam divergence than an LED array and therefore provides a higher power throughput efficiency. A laser array also has a smaller radiating aperture (source size) than an LED array and therefore can provide increased spot density. The narrow spectrum of laser beams enables optical separation of the laser beams as taught in the present application. The broad spectrum precludes similar separations of LED emissions.

It is an object of this invention to provide a color xerographic line printer with simple and inexpensive optics and a single light source.

It is yet another object of this invention to provide a color xerographic printer with a multiple laser array light source with dissimilar wavelengths and dissimilar polarization states.

SUMMARY OF THE INVENTION

In accordance with the present invention, a color printer uses multiple linear arrays of vertical cavity surface emitting lasers of differing wavelengths and polarization states to simultaneously expose widely separated positions on the same or different photoreceptors. A highlight color printer would use two linear laser arrays while a full color printer would use four linear laser arrays.

Each array is imaged to the photoreceptor by the same optical system. The multiple linear arrays can be closely spaced in a monolithic structure or assembled in a precise unit. Light emitting elements in each array can be spaced or staggered for line imaging at the printed pixel density.

Other objects and attainments together with a fuller understanding of the invention will become apparent and appreciated by referring to the following description and claims taken in conjunction with the accompanying drawings.

DESCRIPTION OF THE PREFERRED EMBODIMENT

Figure 2:
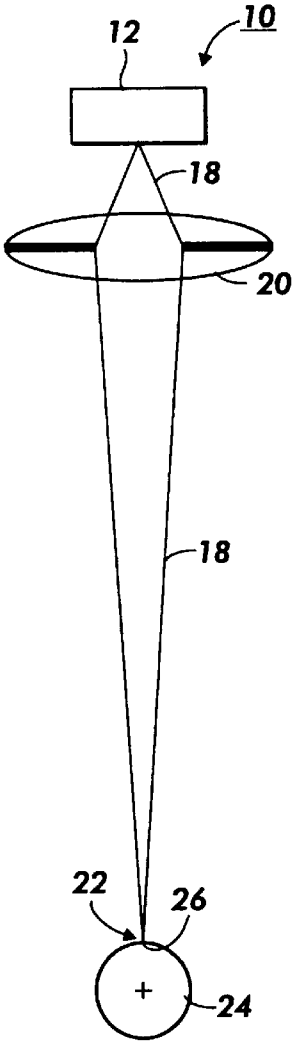
FIG. 2 is a schematic illustration of the cross-section cross-scan plane view of the xerographic printer with a monolithic linear array of vertical cavity surface emitting lasers (VCSELs) of FIG. 1 formed according to the present invention.
Figure 1:
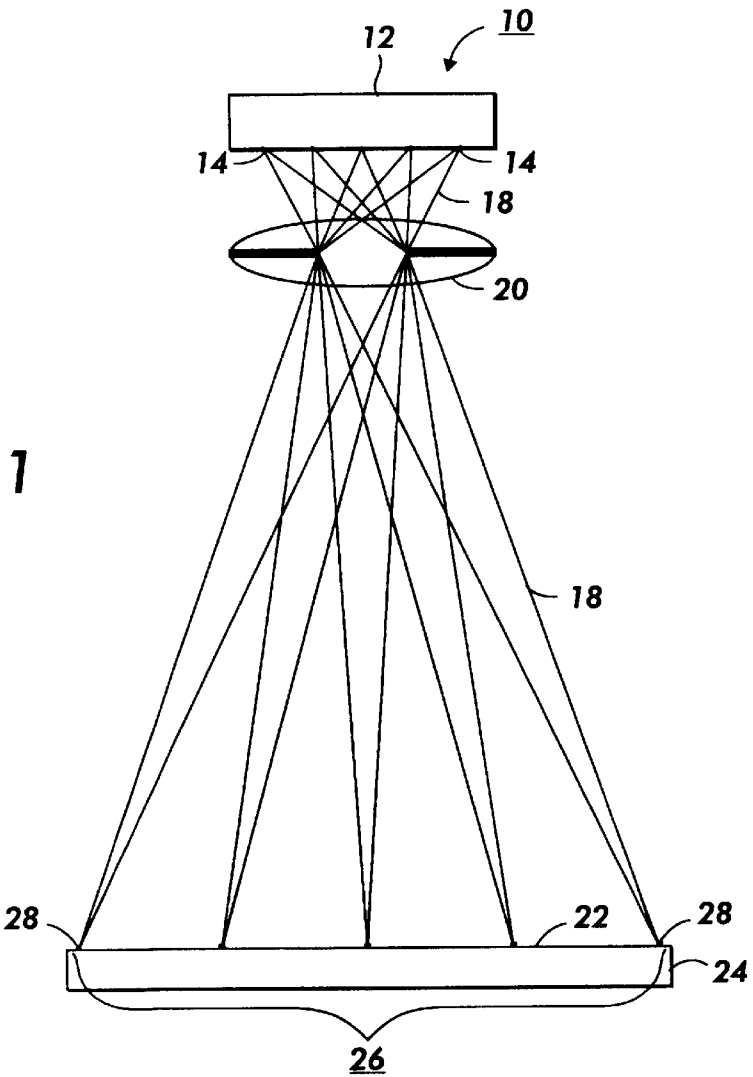
FIG. 1 is a schematic illustration of the cross-section scan plane view of a xerographic printer with a monolithic linear array of vertical cavity surface emitting lasers (VCSELs) formed according to the present invention.

Reference is now made to FIGS. 1 and 2 wherein is described the basic xerographic line printer 10 as used in the illustrated embodiments of the present invention. FIGS. 1 and 2 show the line projection architecture of the printer 10. The optical source of the printer 10 is a linear array 12 of vertical cavity surface emitting lasers (VCSELs) 14, all emitting nominally the same wavelength $\lambda_1$ and same polarization state, as shown in FIG. 3.

Figure 3:
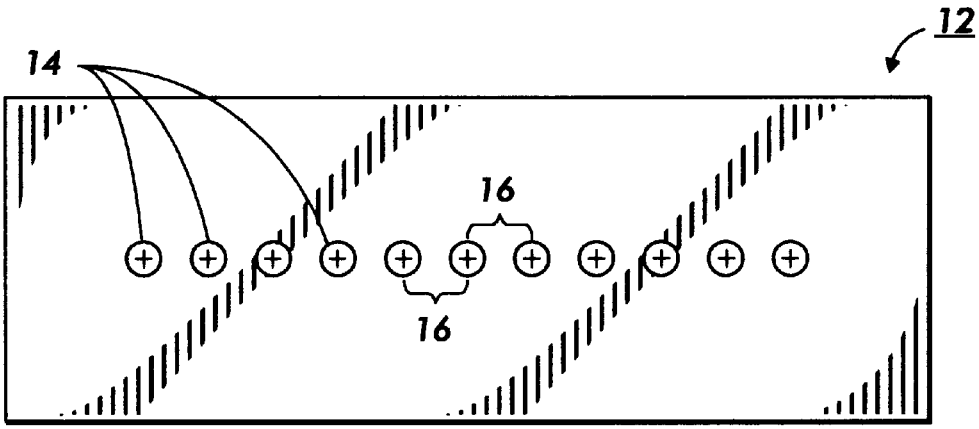
FIG. 3 is a schematic illustration of the cross-section side view of the monolithic linear array of vertical cavity surface emitting lasers (VCSELs) of the xerographic printer of FIGS. 1 and 2 formed according to the present invention.

The individual VCSELs 14 in the array 12 of FIG. 3 are arranged linearly in the scan plane direction with equal center to center spacing 16 between the individual VCSELs 14. The linear VCSEL array 12 is monolithic in the preferred embodiment.

The monolithic VCSEL arrays can be made in many different ways. A high density array of vertical cavity surface emitting lasers can emit from the epitaxial side of the array, as taught in U.S. Pat. No. 5,062,115, commonly assigned to the same assignee as the present application and herein incorporated by reference. A high density array of vertical cavity surface emitting lasers can also emit from the substrate side of the array, as taught in U.S. Pat. No. 5,216,263, commonly assigned to the same assignee as the present application and herein incorporated by reference. In both cases of the previous teachings, all elements of the array emit at substantially the same wavelength and have no provision for control of the polarization state. For some embodiments of the present teaching, the VCSELs 14 in array 12 include polarization control such that each element emits in the same polarization state.

Returning to the line projection architecture of the basic xerographic printer 10 of FIGS. 1 and 2, the linear array 12 of vertical cavity surface emitting lasers (VCSELs) 14 will emit partially overlapping beams 18 of the same wavelength $\lambda_1$ and same polarization state. The VCSEL elements have a beam divergence of about 8 to 10 degrees at the 50% power points and are focused by an imaging lens system 20 onto the surface 22 of the photoreceptor 24.

As shown in FIG. 1, each individual beam 18 from each individual VCSEL 14 in the linear array 12 is focused to a different individual point 28 along a scan line 26 on the photoreceptor surface 22 in the scan plane. As shown in FIG. 2, the beams 18 from the linear array 12 are focused by projection (imaging) lens 20 in both the scan and cross-scan plane to form a single scan line 26 on the photoreceptor surface 22. All the VCSELs in the linear array will be addressed at the same time so that the linear array will simultaneously expose the entire line on the photoreceptor.

The imaging lens system 20 receives the slightly diverging beams 18 from the array 12 and focuses the beams onto the photoreceptor surface 22. The imaging lens 20 also magnifies the beams 18 into the pixels 28 on the photoreceptor surface 22. Typically, the imaging lens can be a relatively inexpensive projection lens with an appropriate magnification and F#.

The optical magnification required for the imaging lens 20 is determined by the length of the array 12 because the full array must cover at least the width of a full sized page. Although it is possible to stitch separate subarrays together linearly to make a long array, monolithic structures are preferred since the individual VCSELs in the array can be aligned during manufacture of the array, particularly photolithographic manufacture. Also, handling of the VCSEL array is minimized if one array is used rather than trying to bond two or more separate subarrays together into one linear array.

A convenient length for monolithic VCSEL arrays would be 35 mm since such arrays can be grown uniformly and handled without serious breakage within present III-V diode technology and 35 mm projection lenses for the imaging lens 20 are readily available.

In an illustrative embodiment of FIG. 1 with a 35 mm long VCSEL array 12 and a 35 mm format projection/imaging lens 20, an optical magnification of approximately 8.5 is needed to cover a scanwidth of 11.7 inches. For an exposure density of 600 spi (spots per inch) along the scan line 26 on the photoreceptor surface 22 in the scan plane, the distance between the spots on the photoreceptor surface is 42 $\mu$m, which at 8.5× magnification requires a center-to-center spacing 16 in FIG. 3 of 5 $\mu$m between individual VCSELs 14 in the array 12. The above optical geometry provides the proper magnification for the scan width and for the spot (pixel) separations along the scan line on the photoreceptor.

The spot size of each pixel 28 on the photoreceptor surface 22 of FIG. 1 is determined by the F# of the imaging lens 20. The approximate F# required to resolve individual elements on 5 $\mu$m centers at 780 nm is given by F# equal to 5 $\mu$m/1.0 $\lambda$ which equals 6.4. With this F#, the lens 20 images the beam 18 of each laser element to a spot with a "full width half maximum" (FWHM) size of 42 $\mu$m, i.e. distance between spots for 600 spi. Thus, adjacent spots on the photoreceptor surface overlap at FWHM. Since individual lasers in a VCSEL array have a half power beam divergence of about 8 to 10 degrees, an imaging lens with F# which equals 6.4 will collect essentially all of the light emitted by each VCSEL element at FWHM. If the light is to be collected at $1/e^2$, the working F# of the lens should be around 3.6. Therefore, the optical efficiency of this printing system 10 can be very high.

Figure 4:
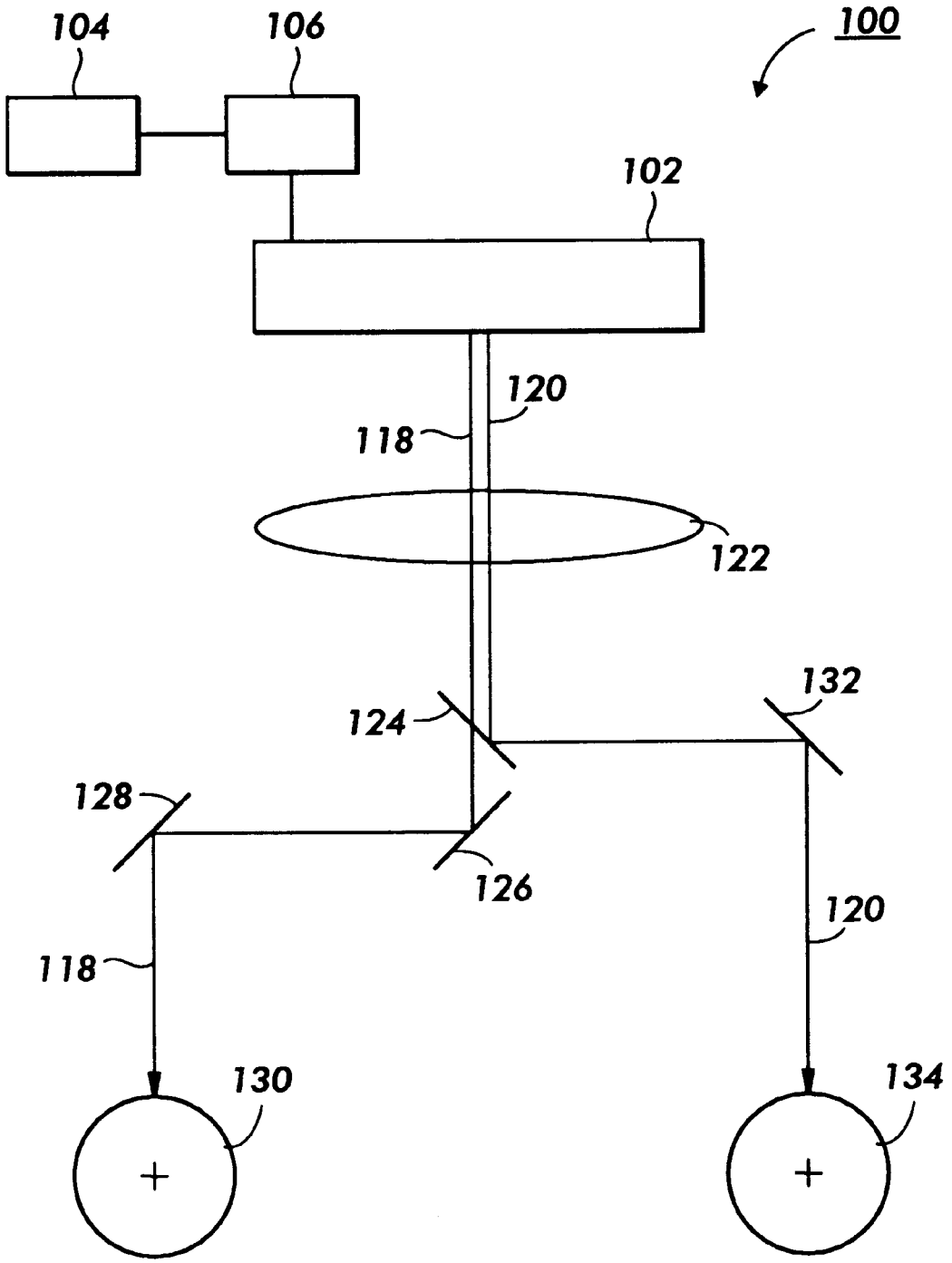
FIG. 4 is a schematic illustration of the cross-section side view of a highlight color xerographic printer with monolithic multiple linear arrays of vertical cavity surface emitting lasers (VCSELs) and two photoreceptors formed according to the present invention.

The highlight color printer 100 of FIG. 4 utilizes a monolithic structure 102 of two linear arrays of vertical cavity surface emitting lasers (VCSELs) to simultaneous expose two photoreceptors to enable one pass highlight color printing.

The monolithic array 102 of the printer 100 is selectively addressed by video image signals representing the image to be printed, processed through Electronic Sub System (ESS) 104 and activated by drive circuit 106 to produce an intensity modulated beam from each individual VCSEL in the array.

Figure 5:
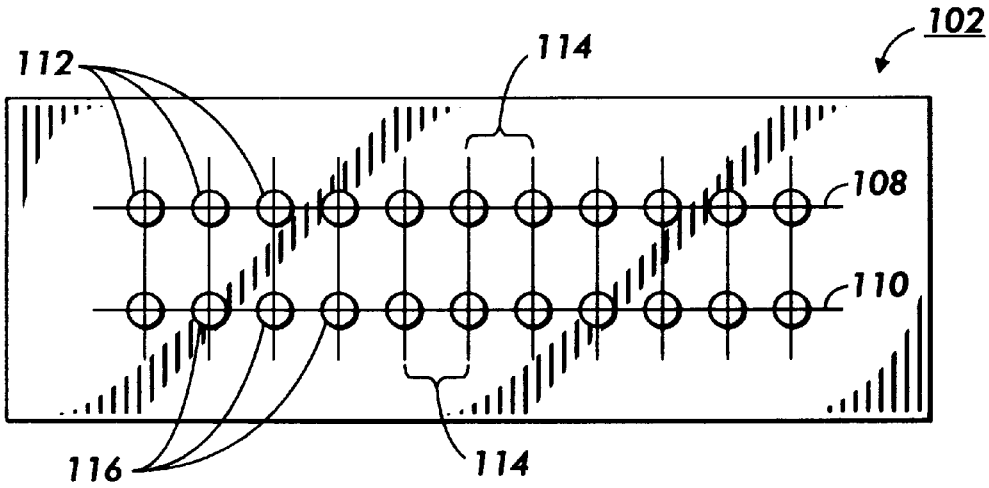
FIG. 5 is a schematic illustration of the cross-section side view of the monolithic multiple linear arrays of vertical cavity surface emitting lasers (VCSELs) of FIG. 4 formed according to the present invention.

The monolithic laser array structure 102 of FIG. 5 consists of two linear VCSEL arrays 108 and 110 aligned parallel to each other within the monolithic array structure 102. The individual VCSELs 112 in the linear array 108 are arranged with equal center to center spacing 114 between the individual VCSELs 112. The individual VCSELs 116 in the linear array 110 are arranged with equal center to center spacing 114 between the individual VCSELs 116. Individual VCSELs 112 are aligned with individual VCSELs 116 in the direction orthogonal to the common linear direction of arrays 108 and 110. In the printer 100 of FIG. 4, the monolithic array structure 102 is aligned so as to form two parallel scan lines orthogonal to the slow scan direction. In the preferred embodiment, the monolithic laser array structure is symmetrically placed in both the slow scan and fast scan directions with respect to the optical axis of the imaging lens 122. Although symmetry is not required in principle, in practice it is highly recommended since a smaller object field for the projection lens permits simpler design and therefore lower cost.

The VCSELs 112 in the linear array 108 emit light at one wavelength with first polarization state. The VCSELs 116 in the linear array 110 emit light at the same wavelength as the VCSELs 112 but with a polarization state orthogonal to the first state. The wavelength of the beam is determined by the photoreceptor, 780 nm is good for infrared sensitive photoreceptors while 680 nm is good for red sensitive photoreceptors. In principle, only orthogonal polarizations without specifying alignment to the sagittal and tangential directions are required for separation of the beams. In practice, it may make the polarization separators easier to fabricate if the polarizations are aligned to the tangential and sagittal directions and therefore this orientation may be preferred.

The monolithic VCSEL array structure 102 with its two linear arrays 108 and 110 can be made in many different ways. A high density array of vertical cavity surface emitting lasers can emit from the epitaxial side of the array, as taught in U.S. Pat. No. 5,062,115, commonly assigned to the same assignee as the present application and herein incorporated by reference. A high density array of vertical cavity surface emitting lasers can emit from the substrate side of the array, as taught in U.S. Pat. No. 5,216,263, commonly assigned to the same assignee as the present application and herein incorporated by reference. In both cases, all elements of the array emit at substantially the same wavelength and have no provision for control of the polarization state.

The array structure 102 may be either a monolithic diode laser array or two nonmonolithic laser subarrays closely spaced into a single integrated array. Orthogonality of the linearly polarized beams may be established either by the relative orientation of the two laser subarrays within the single integrated combination, or by the relative orientation of the linearly polarized beams emitted by a monolithic laser array, as discussed above. With either type of source, the laser array structure 102 provides a substantially common spatial origin for both laser beams.

Returning to the highlight color printer 100 of FIG. 4, the monolithic array structure 102 emits a linear array of modulated polarized beams 118 and a linear array of modulated orthogonally polarized beams 120. The beams 118 and 120 have substantially the same optical wavelength but are typically linearly polarized in orthogonal directions. Only the chief rays are shown.

Figure 6:
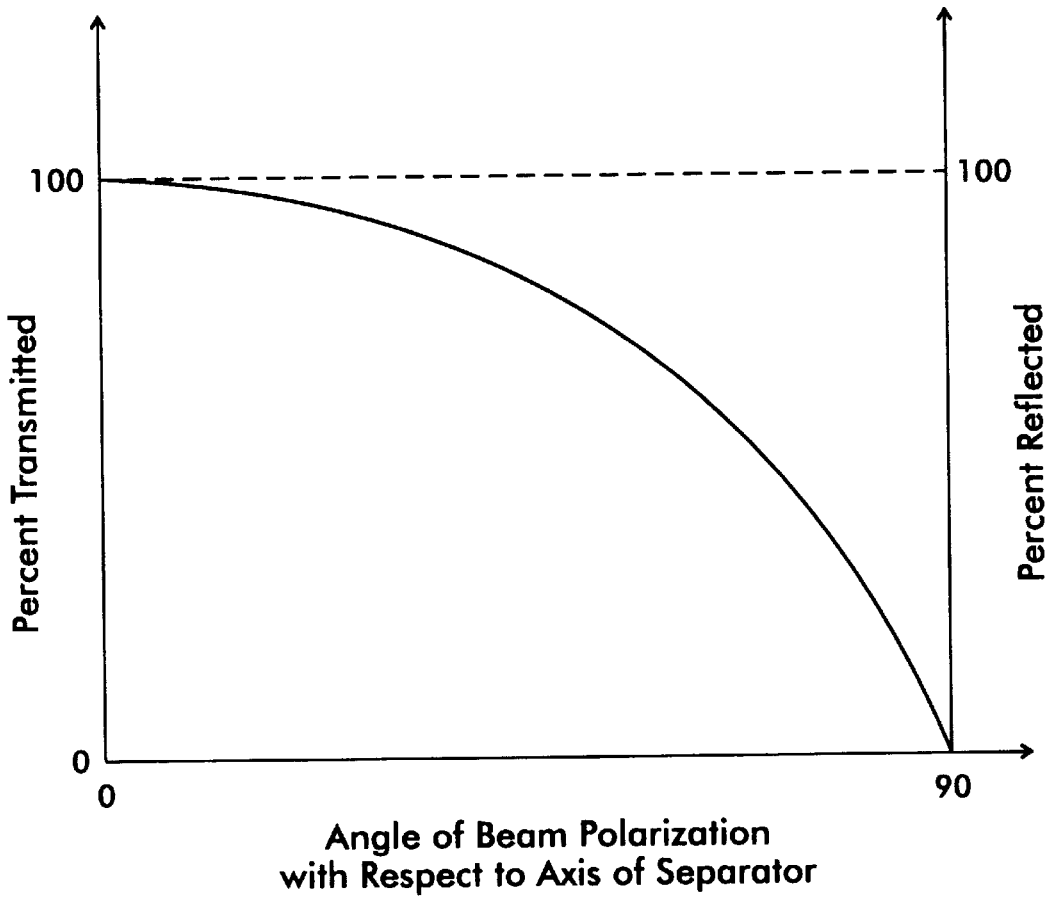
FIG. 6 shows the reflection/transmission characteristics of a polarized beam separator (as used in various embodiments of the present invention).

The beams 118 and 120 are slightly diverging from the array 102 and are focused and magnified by an imaging lens 122 as discussed previously. A polarized beam separator 124 separates the laser beams 118 and 120 after they pass through the imaging lens 122. The beam separator 124 is a polarization selective, multiple layer film, having the optical characteristics shown in FIG. 6.

The polarized laser beam 118 is aligned to be linearly polarized at 0 degrees with respect to the axis of the polarized beam separator 124, while coaxial orthogonally polarized laser beam 120 is linearly polarized at 90 degrees with respect to the axis of the polarized beam separator. Therefore, polarized beam 118 passes through the polarized beam separator 124, while orthogonally polarized beam 120 is reflected at nominally 45° with respect to the incident direction of propagation of the beams. Polarized beam separators such as these polarization selective, multiple layer film or prisms are well known to those in the applicable arts. Reference may be made to Volume 10 of Applied Optics and Optical Engineering, edited by R. R. Shannon and J. C. Wyant, Chapter 10, pp. 51–52.

Mirrors 126 and 128 reflect the separated polarized laser beam 118 from the polarized beam separator 124 onto a first photoreceptor 130, while mirror 132 reflects separated orthogonally polarized laser beam 120 from the polarized beam separator 124 onto a second photoreceptor 134.

Since both beams 118 and 120 are from substantially the same axial location and have substantially parallel optical axes, similarly dimensioned beams with equal optical path lengths are input to the polarized beam separator 124. Thus, the problem of maintaining equal optical path length for each beam reduces to the much simpler problem of maintaining substantially equal optical path lengths from the polarized beam separator 124 to the photoreceptors 130 and 134. Substantially equal optical path lengths are set by properly positioning mirrors 126, 128 and 132. Equalization of optical path lengths results in similarly dimensioned spots at each photoreceptor. Furthermore, since both beams are nominally at the same wavelength, the imaging lens optics do not have to be designed to simultaneously focus two wavelengths at the same distance.

The imaging lens forms a magnified image of each VCSEL array on the appropriate photoreceptor. Although not depicted in the illustration, the path lengths from the imaging lens to all photoreceptors are made equal so that the optical magnification of each linear array is the same in each arm of the system. A reasonable number for this distance is 21 inches, which is compatible with the space allotted to one pass 4 colors/single polygon/single optics ROSs in current printer designs. Since adjacent linear arrays are imaged at different positions, the sagittal spacing between them can be as large as the field of view of the projection lens allows. This is because the output of each array is directed to its exposure position by the polarization separators and mirrors shown in the Figures. Synchronization between exposures at different positions is controlled by the relative times at which the arrays are addressed.

The photoreceptors 130 and 134 are charged by a charging stations (not shown) prior to exposure by beams 118 and 120 respectively. After exposure, a development station (also not shown) develops the latent image formed in the associated image area on the photoreceptor. A fully developed image is then transferred to a single output sheet (not shown) at a transfer station (not shown) from each of the two photoreceptors 130 and 134. The charge, development and transfer stations are conventional in the art. Further details of xerographic stations in a multiple exposure single pass system are disclosed in U.S. Pat. Nos. 4,661,901; 4,791,452; and 4,833,503; all three patents herein incorporated by reference.

The printer 100 may be used for two color printing where the image created on each photoreceptor 130 and 134 corresponds to a different system color. This color printing is typically black and a highlight color.

The printer 100 of FIG. 4 is a highlight color xerographic printer with a monolithic structure of two linear arrays of vertical cavity surface emitting lasers (VCSELs) to expose positions on two photoreceptors.

Figure 7:
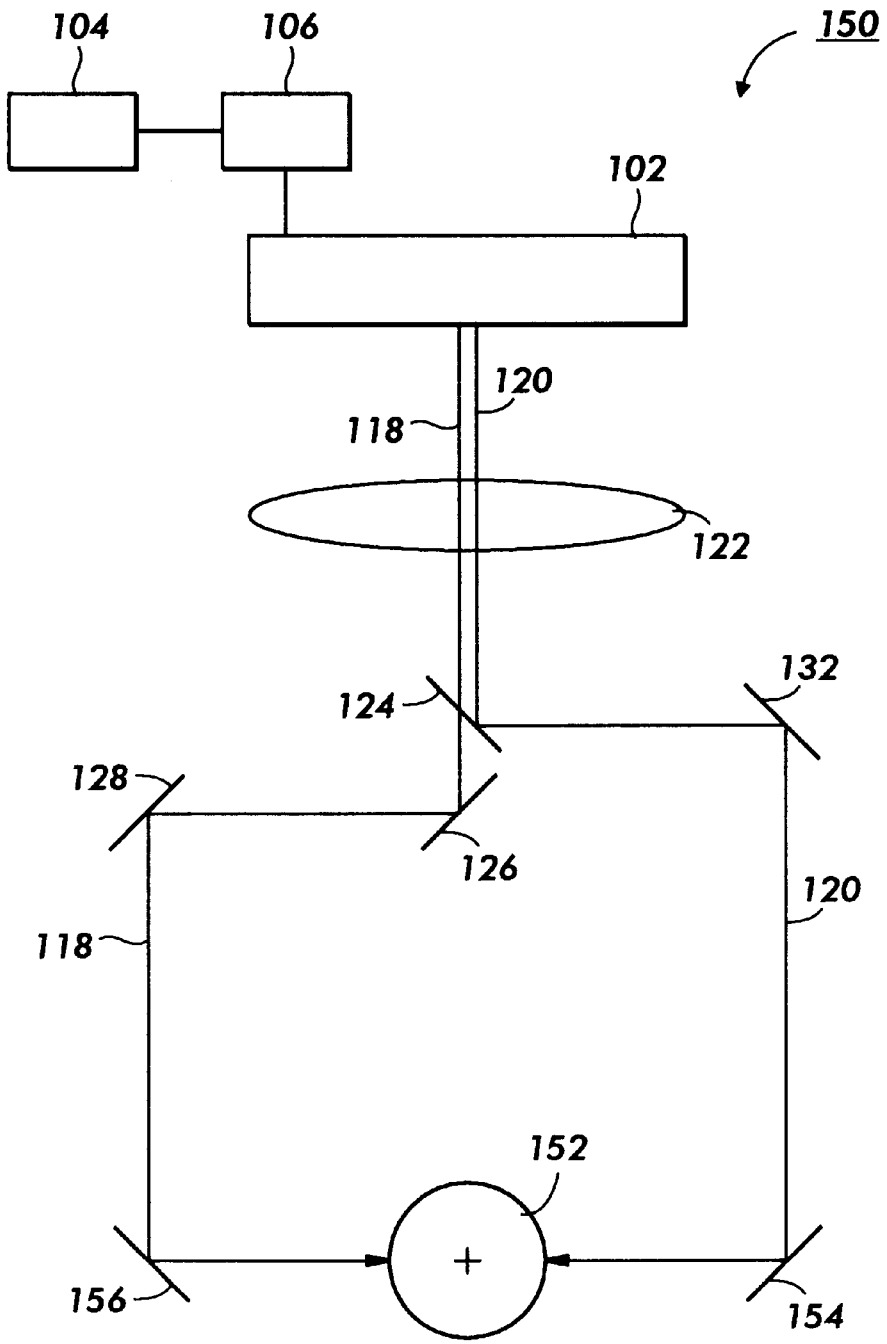
FIG. 7 is a schematic illustration of the cross-section side view of an alternate embodiment of a highlight color xerographic printer with monolithic multiple linear arrays of vertical cavity surface emitting lasers (VCSELs) and a single photoreceptor formed according to the present invention.

The printer 150 of FIG. 7 is a highlight color xerographic line printer where the two arrays in the monolithic VCSEL array structure expose two positions on a single photoreceptor 152 to enable one pass highlight color printing.

The printer 150 of FIG. 7 shows an alternate embodiment of printer 100 of FIG. 4 wherein the polarized light beams 118 and 120 are directed onto a single photoreceptor 152 by reflecting mirrors 154 and 156. Laser array structure 102 of FIG. 7 emits a polarized beam 118 and an orthogonally polarized beam 120. The video signals for both beams are processed by Electronic Sub System (ESS) 104 and the beams are modulated by drive circuit 106. The two beams 118 and 120 are focused and magnified by imaging lens 122 and separated by polarized beam separator 124. Mirrors 126 and 128 reflect the separated polarized laser beam 118 from the polarized beam separator 124, while mirror 132 reflects separated orthogonally polarized laser beam 120 from the polarized beam separator 124. Thus far, the highlight color xerographic printer 150 of FIG. 7 is the same as the highlight color xerographic printer 100 of FIG. 4.

However in the highlight color xerographic printer 150 of FIG. 7, the polarized laser beam 118 is reflected from mirror 128 and then reflected from mirror 156 onto one area of the photoreceptor 152. The orthogonally polarized laser beam 120 is reflected from mirror 132 and then reflected from mirror 154 onto a separate area of the photoreceptor 152. As noted previously, the subsequent charge, development and transfer stations are conventional in the art.

The polarized beam separator 124 of FIGS. 4 to 7 transmits the polarized beam 118 while reflecting the orthogonally polarized beam 120. An alternate means of separating cross-polarized beams is use of an absorptive/transmissive polarizer.

Figure 8:
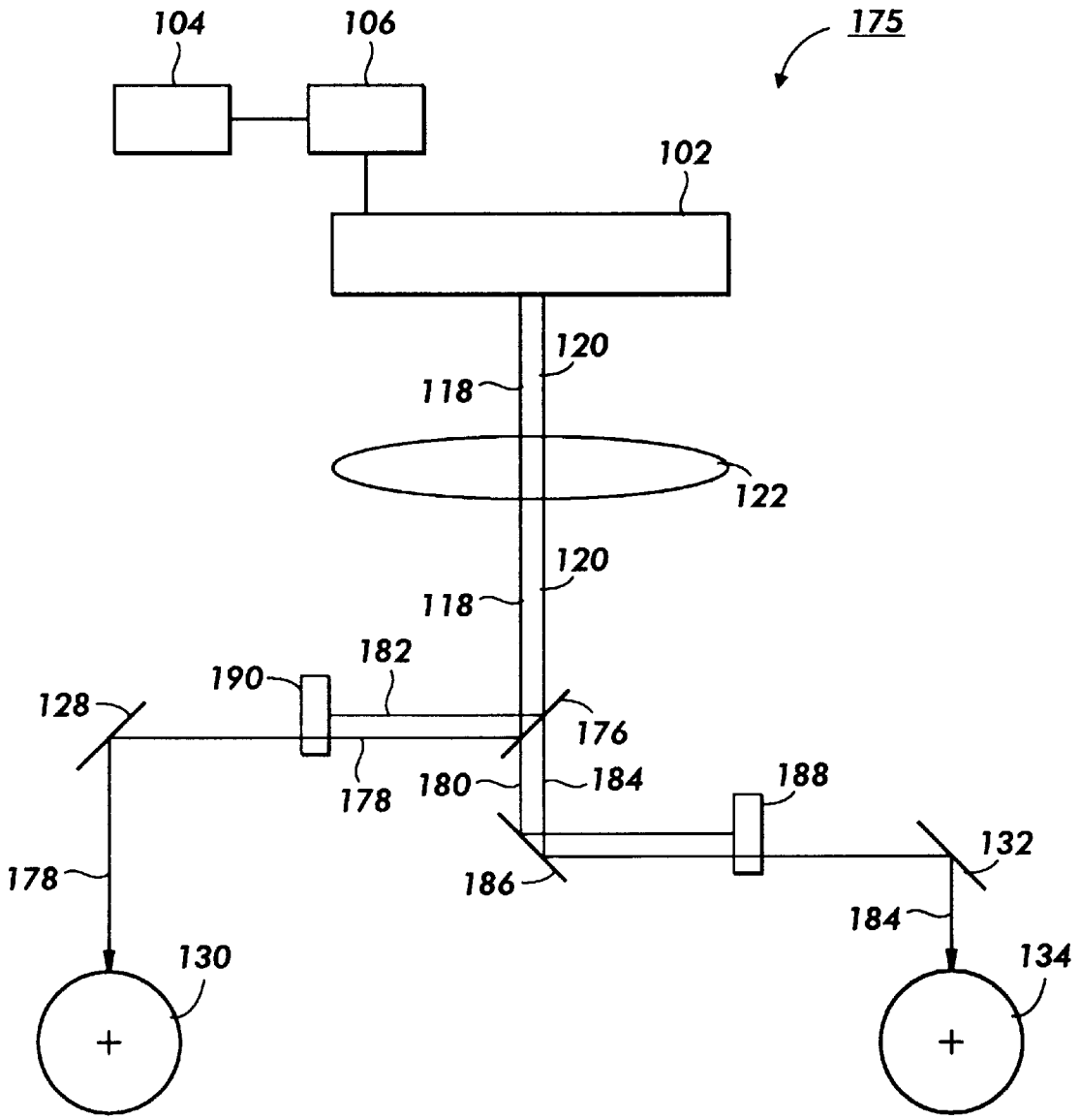
FIG. 8 is a schematic illustration of the cross-section side view of an alternate embodiment of the highlight color xerographic printer with monolithic multiple linear arrays of vertical cavity surface emitting lasers (VCSELs) and polarization beam separators and two photoreceptors formed according to the present invention.

The printer 175 of FIG. 8 shows an alternate embodiment of printer 100 of FIG. 4 wherein an absorptive/transmissive polarizer is utilized to separate the polarized light beams. Laser array structure 102 of FIG. 8 emits a polarized beam 118 and an orthogonally polarized beam 120. The video signals for both beams are processed by Electronic Sub System (ESS) 104 and the beams are modulated by drive circuit 106. The two beams 118 and 120 are focused and and the laser spacing is magnified by imaging lens 122. Thus far, the highlight color xerographic printer 150 of FIG. 8 is the same as the highlight color xerographic printer 100 of FIG. 4.

The two beams 118 and 120 are then split by beam splitter 176. The beam 118 is divided into beam 178 which is reflected from the beam splitter and beam 180 which is transmitted through the beam splitter 176. The beams 178 and 180 have the same wavelength and polarization state as the original beam 118 but only half its intensity. Similarly, the beam 120 is divided into beam 182 which is reflected from the beam splitter and beam 184 which is transmitted through the beam splitter 176. The beams 182 and 184 have the same wavelength and orthogonal polarization state as the original beam 120 but only half its intensity.

The beam splitter 176 is a partially transparent metallic film or a multiple layer dielectric film constructed such that half the intensity of an incident beam is transmitted while the other half is reflected. Such beam splitters are well known to those skilled in the arts and are frequently used optical components. Splitting both beams can be advantageous in spite of the increased power loss because it enables use of relatively low cost absorptive/transmissive polarizers for beam separation.

Figure 9:
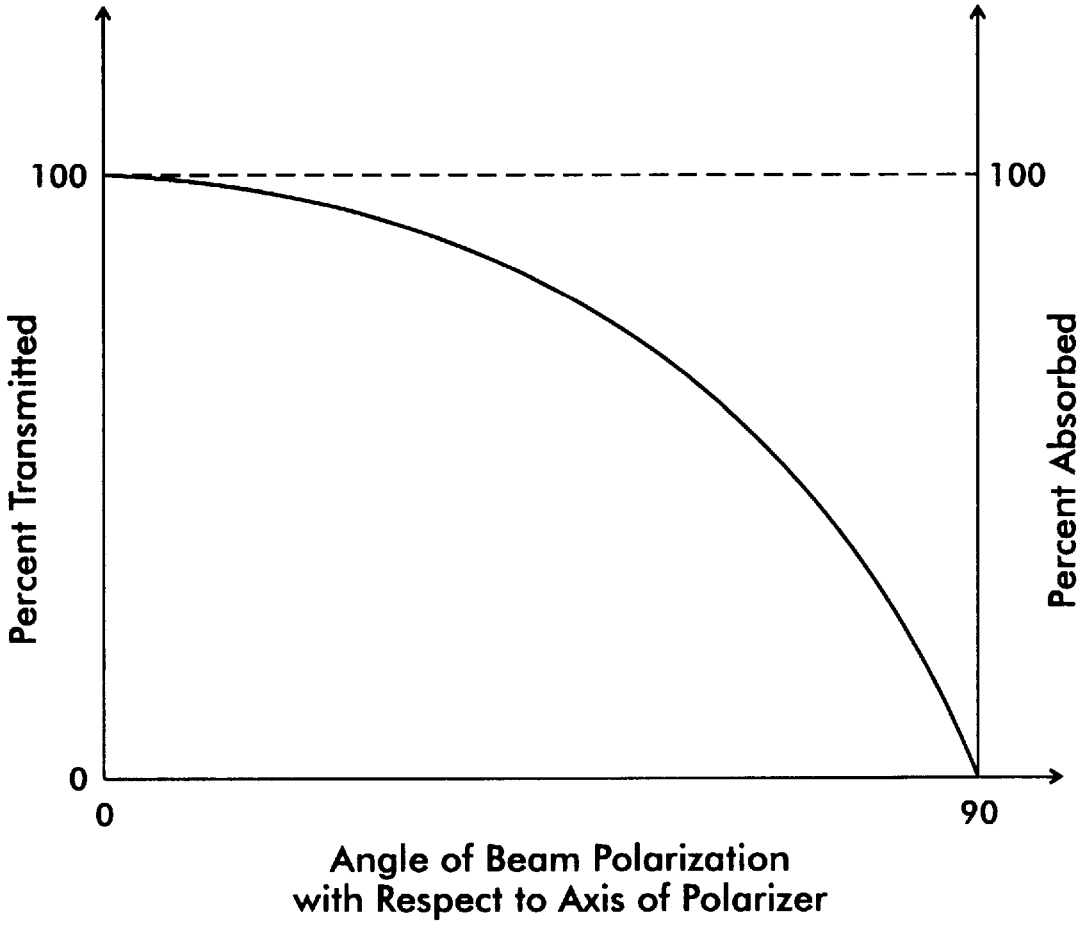
FIG. 9 shows the absorption/transmission characteristics of a polarized beam separator as used in the highlight color xerographic printer of FIG. 8.

After transmission through the beam splitter 176, polarized light beam 180 and orthogonally polarized light beam 184 are reflected by mirror 186 onto absorptive/transmissive polarizer 188. The absorptive polarizer 188 has absorption/transmission characteristics as shown in FIG. 9. The absorptive polarizer is made from a material which absorbs light polarized in a particular direction while transmitting light polarized in the orthogonal direction. The polarizer 188 is aligned such that it absorbs polarized light beam 180 while transmitting orthogonally polarized light beam 184.

Similarly, after reflection from the beam splitter 176, polarized light beam 178 and orthogonally polarized light beam 182 are directed onto absorptive polarizer 190. Absorptive polarizer 190 has the same absorption/transmission characteristics as absorptive polarizer 188. The polarizer 190 is aligned such that it absorbs orthogonally polarized light beam 182 while transmitting polarized light beam 178.

Then returning to the same optical path and optical components as the printer 100 of FIG. 4, the polarized light beam 178 is reflected by mirror 128 onto the first photoreceptor 130 while the orthogonally polarized light beam 184 is reflected by mirror 132 onto the second photoreceptor 134 in FIG. 8.

Outside of mirrors to reflect the beams and adjust the optical path length, the distinction between the printer 100 of FIG. 4 and the printer 175 of FIG. 8 is that the polarized beam separator 124 of FIG. 4 is replaced with a beam splitter 176 and two absorptive polarizers 188 and 190 of FIG. 8 and that the beams on the photoreceptors in printer 175 of FIG. 8 will have half the intensity of the comparable beams on the photoreceptors in printer 100 of FIG. 4 for the same intensity emitted by elements in array 102.

Figure 10:
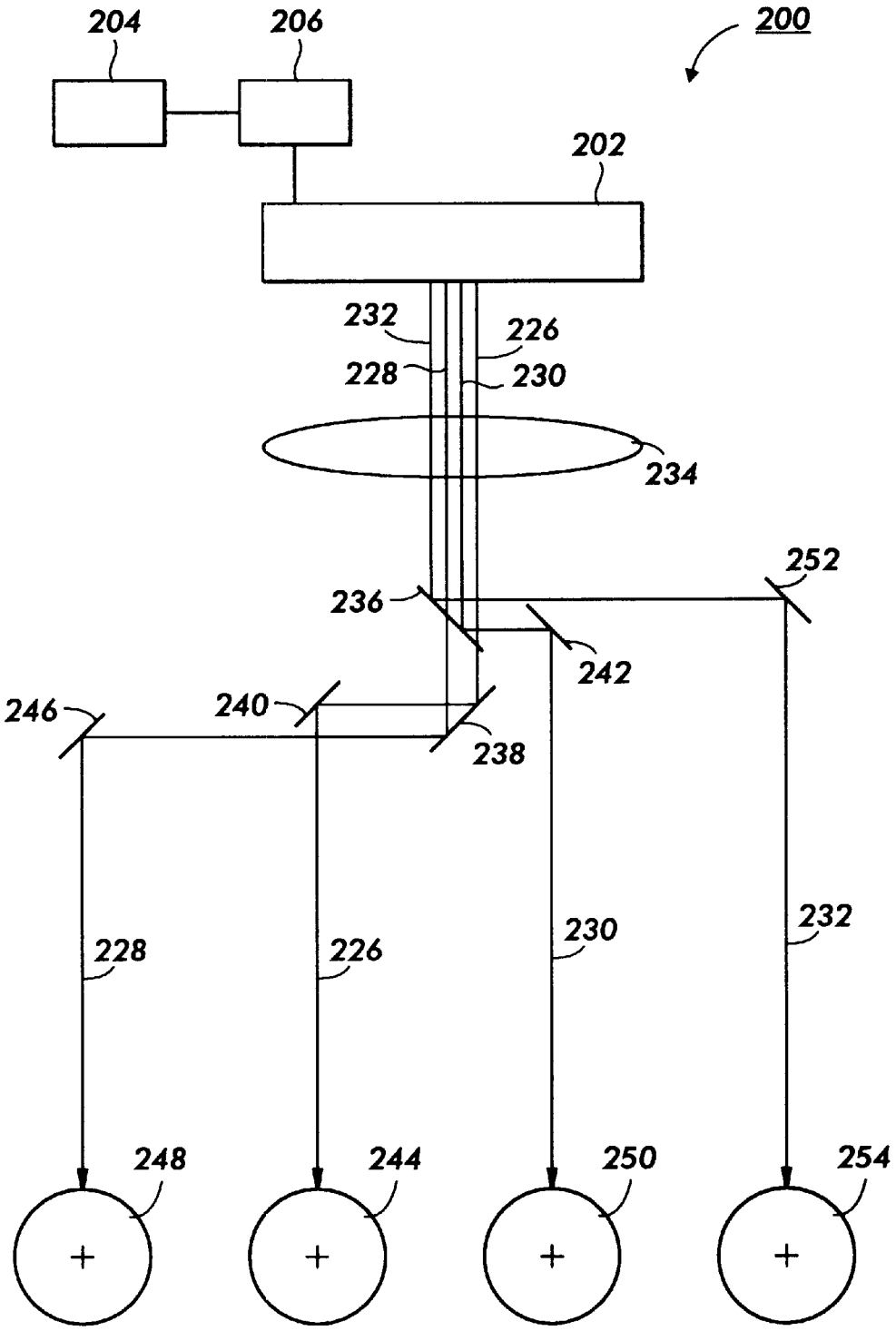
FIG. 10 is a schematic illustration of the cross-section side view of a full color xerographic printer with monolithic multiple linear arrays of vertical cavity surface emitting lasers (VCSELs) and four photoreceptors formed according to the present invention.

The full color printer 200 of FIG. 10 utilizes a monolithic structure 202 of four linear arrays of vertical cavity surface emitting lasers (VCSELs) to expose four photoreceptors to enable one pass full color printing.

The monolithic array structure 202 of the printer 200 is selectively addressed by video image signals processed through Electronic Sub System (ESS) 204 and modulated by drive circuit 206 to produce a modulated beam from each individual VCSEL in the array.

Figure 11:
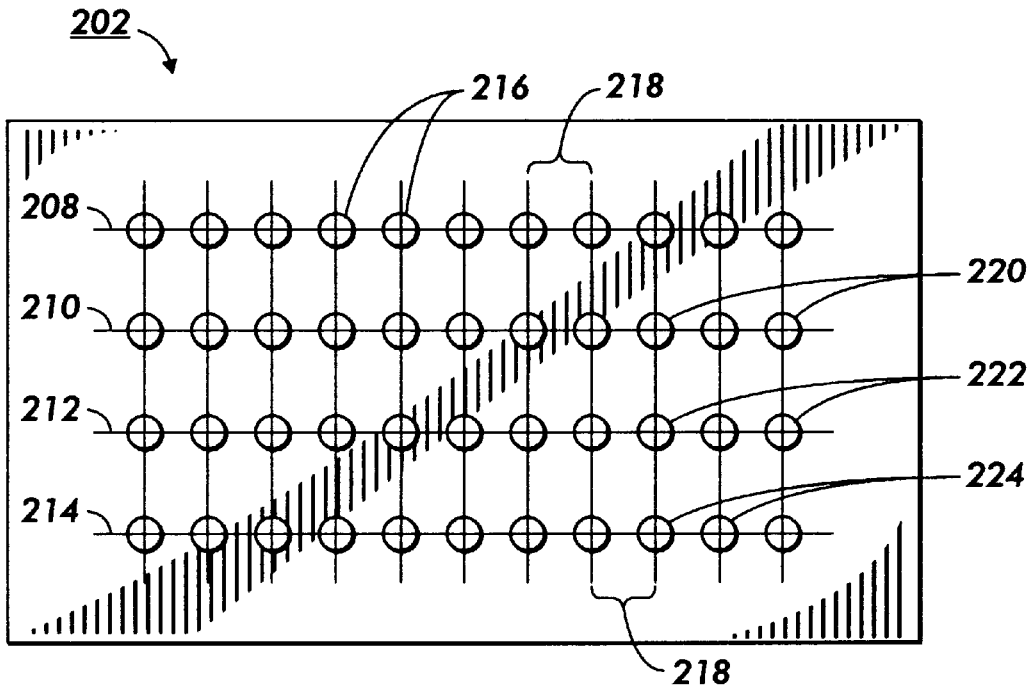
FIG. 11 is a schematic illustration of the cross-section front view of the monolithic multiple linear arrays of vertical cavity surface emitting lasers (VCSELs) of FIG. 10 formed according to the present invention.

The laser array structure 202 of FIG. 11 consists of four linear VCSEL arrays 208, 210, 212 and 214 aligned and arranged in parallel to each other within the monolithic array 202. Individual VCSELs within each of the four linear arrays are arranged with equal center to center spacing 216 between individual VCSELS. Individual VCSELs in each linear array are aligned with individual VCSELs in the other linear arrays in the direction orthogonal to the common linear direction of the arrays. In the printer 200 of FIG. 10, the monolithic array structure 202 is aligned so as to form four parallel scan lines orthogonal to the slow scan direction. In the preferred embodiment, the monolithic laser array structure is symmetrically placed with respect to the optical axis of the imaging lens 234 in both the slow scan and fast scan directions.

The VCSELs 216 in the linear array 208 emit light at a first wavelength with a defined polarization. The VCSELs 220 in the linear array 210 emit light at the first wavelength with a polarization state orthogonal to the polarization state of VCSELs in array 208. The VCSELs 222 in the linear array 212 emit light at a second wavelength with the same polarization state as VCSELs in array 208. The VCSELs 224 in the linear array 214 emit light at the second wavelength with polarization state orthogonal to the polarization state of VCSELS in array 208. The range of wavelengths is chosen to accommodate the responsitivity of the photoreceptors and their proximity is limited by the selectivity of the optical filters.

The laser array structure 202 is a monolithic combination of four linear arrays, each of which emits at one of two different wavelengths and one of two orthogonal polarization states. The use of two wavelengths, instead of four, considerably simplifies the construction of the laser device and the requirements placed on the photoreceptive elements and the optical filters compared to the 4 wavelength system described in co-filed application D/95544. With 4 wavelengths, the spectral response must be constant over 3 times the spectral range compared with 2 wavelengths. In addition, it is much simpler to design the optical filters for only 2 wavelengths.

The VCSEL array structure 202 with its four linear arrays 208, 210, 212 and 214 may be either a monolithic diode laser array or two nonmonolithic laser subarrays closely spaced into a single integrated array, as discussed previously.

The monolithic array structure 202 emits a linear array of modulated polarized beams 226 of the first wavelength, modulated orthogonally polarized beams 228 of the first wavelength, modulated polarized beams 230 of the second wavelength with the same polarization as beams 226, and modulated orthogonally polarized beams 232 of the second wavelength. Only the chief rays are shown.

The beams 226, 228, 230 and 232 are diverging from the array 202 and are focused by imaging lens 234 as discussed previously. A polarized beam separator 236, separates the laser beams 226, 228, 230 and 232 after they pass through the imaging lens 234. The beam separator 236 is a thin film structure of multiple dielectric layers having the polarization-selective optical characteristics shown in FIG. 6.

The polarized beam separator 236 separates the polarized beams 226 and 230 from the orthogonally polarized beams 228 and 232. Polarized beams 226 and 230 transmit through the beam separator 236, reflect off mirror 238 and into the wavelength selective beam separator 240 while orthogonally polarized beams 228 and 232 reflect off the beam separator 236 and into the wavelength selective beam separator 242.

Figure 12:
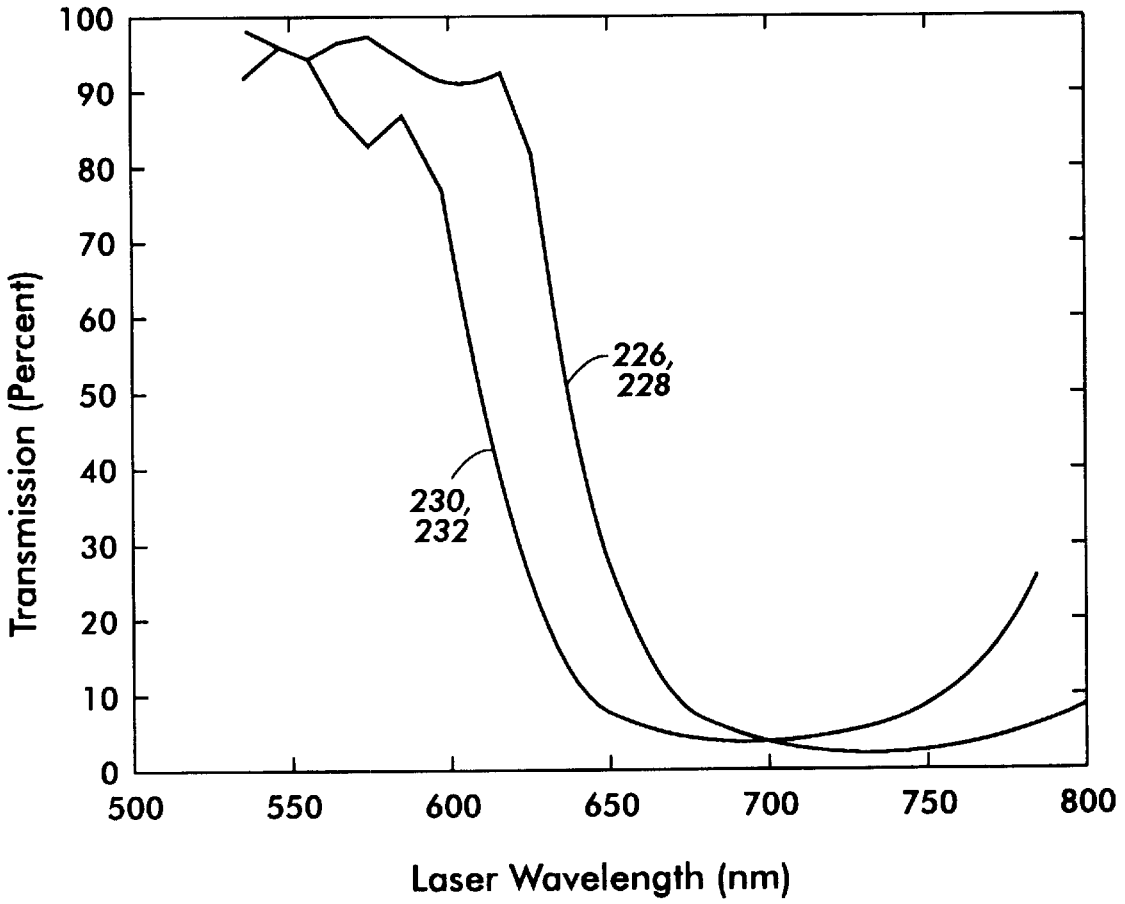
FIG. 12 shows the reflection/transmission characteristics of a wavelength beam separator of the full color xerographic printer of FIG. 10.

The wavelength selective beam separators 240 and 242 are wavelength selective multiple layer films having optical characteristics similar to those shown in FIG. 12. Thus, for two wavelengths appropriately matched to the optical characteristics of the beam separator, e.g. 600 nm and 650 nm, a beam of one wavelength will be transmitted while a beam of the other wavelength will be reflected. FIG. 12 shows the percentage of the beam transmitted for two incident angles. By subtraction, the remainder percentage of the beam is reflected. Such beam separators are well known in the art. Reference may be had to Volume 1 of "Applied Optics and Optical Engineering", (1965) edited by R. Kingslake, in several places, including chapter 5, number IV and chapter 8, numbers VIII and IX.

Thus, the beam separator 240 will reflect polarized beam 226 of the first wavelength onto a first photoreceptor 244. The beam separator 240 will transmit polarized beam 230 of the second wavelength which is reflected by mirror 246 onto the second photoreceptor 248.

The beam separator 242 will reflect the orthogonally polarized beam 228 of the first wavelength onto a third photoreceptor 250. The beam separator 242 will transmit the orthogonally polarized beam 232 of the second wavelength which is reflected by mirror 252 onto the fourth photoreceptor 254.

Since each laser beam is independently modulated with image information, a distinct latent image is simultaneously printed on each photoreceptor. As noted previously, the subsequent charge, development and transfer stations are conventional in the art. Thus apparatus 200 may be used for full color reproduction, wherein the image on each photoreceptor corresponds to a different system color.

Since all of the beams 226, 228, 230 and 232 are from substantially the same focal plane and have substantially parallel optical axes, similarly dimensioned beams are input to the polarized beam separator 236. Thus the problem of maintaining equal optical path lengths for each beam reduces to the much simpler problem of maintaining substantially equal optical path lengths from the polarized beam separator 236 to the individual photoreceptors. Substantially equal optical path lengths are set by adjusting the individual optical path lengths by properly positioning mirrors 238, 240, 242, 246 and 252.

In the full color printer 200 of FIG. 10, the beams are first separated by polarization states, then by wavelength.

However, it is not essential that the polarized beam separator 236 be before the wavelength-selective beam separators 240 and 242 in the optical path. The beams can be separated by wavelength before the beams are separated by polarization states. Thus, a single wavelength-selective beam separator can separate the four beams by wavelength, then two polarized beam separators can further separate the beams by polarization states. The order and locations of the photoreceptors would accordingly change based on the new positions of the beams.

As shown in the highlight color printer 150 of FIG. 7, the highlight color printer 100 of FIG. 4 can be adapted with the addition of mirrors to expose two separated positions on a single photoreceptor rather than multiple photoreceptors. Similarly, the full color printer 200 of FIG. 10 can be adapted with the addition of mirrors to expose four separated positions on a single photoreceptor drum rather than multiple photoreceptors. Alternatively, the full color printer 200 of FIG. 10 can be adapted without additional mirrors to expose four separated positions on a single photoreceptive belt rather than multiple photoreceptive drums.

Similarly, as shown in FIG. 8, the polarization beam separator 236 of FIG. 10 can be replaced with a beam splitter and two absorptive polarizers with the resulting halving of the intensity of the beams upon the photoreceptors, however.

Another alternate embodiment with a two wavelength/two polarization state color printer would be the use of wavelength bandpass filters instead of the wavelength-selective beam separators 240 and 242. However, like the absorptive polarizers of FIG. 8, a beam splitter is required and there is a resulting halving of the intensity of the beams upon the photoreceptors.

In this embodiment, the beams from the array structure would be separated by polarization states, then the two beams of a first and a second wavelength with the same polarization would be split by a beam splitter. These two beams would be directed onto different optical paths. One path would lead to a first wavelength-selective bandpass filter which transmits the first wavelength but blocks the second wavelength. Thus, the polarized beam of the first wavelength would pass through the first wavelength-selective bandpass filter to the first photoreceptor or the first location of a single photoreceptor. The second path would lead to a second wavelength-selective bandpass filter which transmits the second wavelength but blocks he first wavelength. Thus, the beam of the second wavelength with the same polarization would pass through the second wavelength-selective bandpass filter to the second photoreceptor or the second location of a single photoreceptor.

Similarly, the two beams of a first and a second wavelength with polarizations orthogonal to the first polarization state would be split by a beam splitter, then filtered through different wavelength-selective bandpass filters, one for each of the two wavelengths, and then to two photoreceptors or two locations on the same photoreceptor.

Again, the beam splitter and two wavelength-selective bandpass filters can come before the wavelength separators in the optical path of the color printer.

The beam splitter and wavelength-selective bandpass filters for wavelength separation could be combined in a color xerographic printer with the beam splitter and two absorptive polarizers for polarization separation. However, the resulting intensity of the beams upon the photoreceptor is now a quarter of the beam's intensity from the multiple laser array light source.

Figure 13:
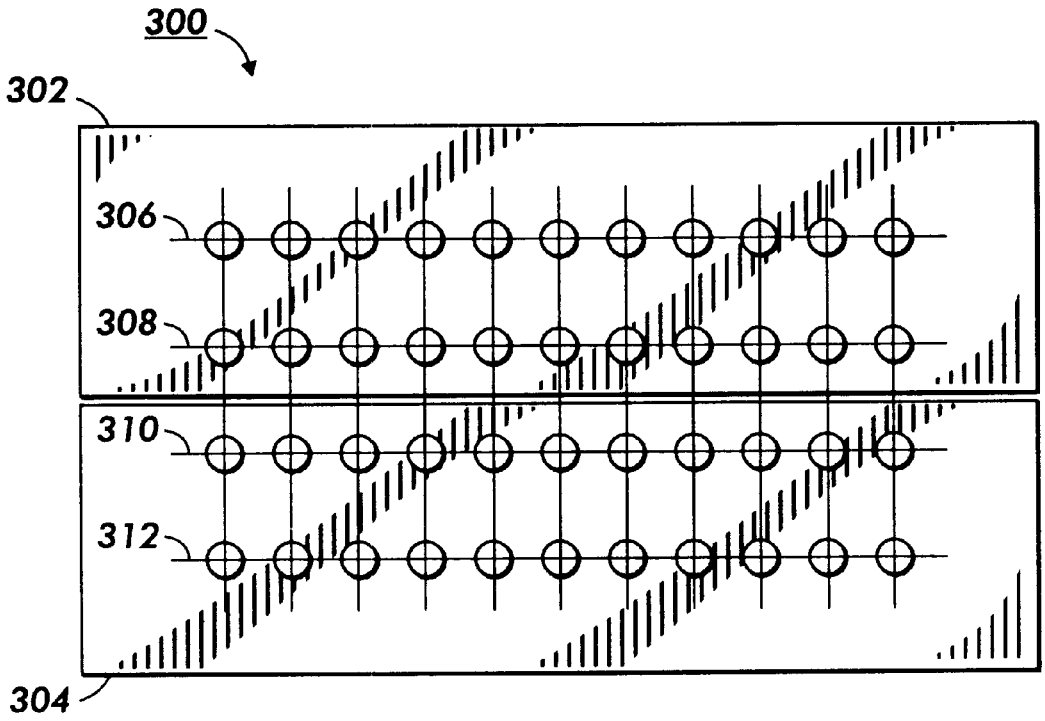
FIG. 13 is a schematic illustration of the cross-section front view of the nonmonolithic structure combination of two monolithic multiple linear arrays of vertical cavity surface emitting lasers (VCSELs) formed according to the present invention.

The laser array structure 300 of FIG. 13 is a nonmonolithic combination of two monolithic structures 302 and 304 of VCSEL arrays. Each monolithic array structures contains two cross-polarized linear arrays of VCSELs emitting at the same wavelength. The wavelengths emitted by the two monolithic array structures are different. Monolithic array structure 302 has linear VCSEL array 306 emitting with a defined polarization state at a first wavelength and linear VCSEL array 308 emitting with the orthogonal polarization state at the first wavelength. Monolithic array structure 304 has linear VCSEL array 310 emitting with the same polarization state as array 306 at a second wavelength and linear VCSEL array 312 with the orthogonal polarization state emitting at the second wavelength.

Thus, the laser array structure 300 of FIG. 13 emits two different wavelengths and two polarization states, similar to the monolithic array structure 202 of FIG. 11. The advantage of this nonmonolithic combination is that each monolithic array structure 302 and 304 needs to emit only one wavelength, thereby relaxing the requirements on the layer growths.

The sagittal separation between adjacent arrays on different monolithic array structures can be much larger than the tangential spacing between the VCSEL elements, since each array is imaged at a different exposure position. The sagittal spacing between monolithic subarray structures is minimized by locating the linear arrays near the edge of each monolithic subarray structure. However it is important to have array elements on different monolithic subarray structures aligned sagitally in order to avoid scan line alignment on the four development stations. Precise alignment of the scan lines at different stations is required since the four images are transferred serially to paper or an intermediate transfer belt. A nonmonolithic combination of monolithic dual wavelength subarray structures is preferred to an all monolithic structure source because it minimizes the wavelength range over which the active layer must provide gain and grown laser mirrors must provide high reflectivity within each VCSEL in each monolithic structure.

Gain guided VCSELs are well suited for the color printing applications of the embodiments because they exhibit essentially no astigmatism. In addition, variation of the imaging lens' focal length due to the wavelength dependence of its refractive index can be compensated by (1) adding a glass plate to one array or by (2) monolithically adding an appropriate diffractive lens to individual elements of one array, as taught in U.S. Pat. No. 5,073,041, herein incorporated by reference.

A monolithic structure of two or four VCSEL arrays of the present invention is cheaper to manufacture than the two or four separate LED print bars of the prior art. The VCSEL arrays are accurately aligned within the monolithic structure as opposed to the prior art four separate LED print bars which must be accurately aligned with each other.

A monolithic structure of two or four VCSEL arrays considerably reduces the size and total spatial volume of a color xerographic printer. And monolithic source arrays are cost-effective since assemblies of multiple chips is reduced or in some cases eliminated.

The imaging lens of the present invention can compensate for focal length dispersion either by color correcting the lens or by inserting a glass plate into the beams emitted by an array or by monolithically adding an appropriate diffractive lens to individual elements of an array. The complex and expensive optics of a prior art ROS system are reduced to the imaging lens of the present invention.

While the invention has been described in conjunction with specific embodiments, it is evident to those skilled in the art that many alternatives, modifications and variations will be apparent in light of the foregoing description. Accordingly, the invention is intended to embrace all such alternatives, modifications and variations as fall within the spirit and scope of the appended claims.

What is claimed is:

1. A highlight color xerographic line printer comprising a first and second photoreceptor, a first linear laser array for emitting first modulated light beams of a certain wavelength and polarization state and a second linear laser array for emitting second modulated light beams of the same wavelength as the first modulated beams but with the orthogonal polarization state, imaging lens means for imaging said first modulated light beams and said second modulated light beams onto said first and second photoreceptor, and polarization beam separating means for separating said first modulated light beams onto said first photoreceptor to simultaneously expose a full scan line and said second modulated light beams onto said second photoreceptor to simultaneously expose a full scan line.

2. The highlight color xerographic line printer according to claim 1 wherein said polarization beam separating means is a multiple layer film polarized beam separator.

3. The highlight color xerographic line printer according to claim 1 wherein said polarization beam separating means is a prism polarized beam separator.

4. The highlight color xerographic line printer according to claim 1 wherein said polarization beam separating means is a beam splitter and two absorptive polarizers.

5. A highlight color xerographic line printer comprising a photoreceptor, a first linear laser array for emitting first modulated light beams of a certain wavelength and polarization state and a second linear laser array for emitting second modulated light beams of the same wavelength as the first modulated beams but with the orthogonal polarization state, imaging lens means for imaging said first modulated light beams and said second modulated light beams onto said first photoreceptor, and polarization beam separating means for separating said first modulated light beams onto a first region of said photoreceptor to simultaneously expose a full scan line and said second modulated light beams onto a second region of said photoreceptor to simultaneously expose a full scan line.

6. The highlight color xerographic line printer according to claim 5 wherein said polarization beam separating means is a multiple layer film polarized beam separator.

7. The highlight color xerographic line printer according to claim 6 wherein said polarization beam separating means is a prism polarized beam separator.

8. The highlight color xerographic line printer according to claim 6 wherein said polarization beam separating means is a beam splitter and two absorptive polarizers.

9. A full color xerographic line printer comprising a first, second, third and fourth photoreceptor, a first linear laser array for emitting first modulated light beams of a first wavelength and a first polarization state, a second linear laser array for emitting second modulated light beams of the first wavelength and a second polarization state orthogonal to the said first polarization state, a third linear laser array for emitting third modulated light beams of a second wavelength, different from said first wavelength, and said first polarization state, and a fourth linear laser array for emitting fourth modulated light beams of the second wavelength and said second polarization state, imaging lens means for imaging said first, second, third and fourth modulated light beams onto said first, second, third and fourth photoreceptor, and polarization beam separating means and wavelength separation means for separating said first modulated light beams onto said first photoreceptor to simultaneously expose a full scan line, said second modulated light beams onto said second photoreceptor to simultaneously expose a full scan line, said third modulated light beams onto said third photoreceptor to simultaneously expose a full scan line, and said fourth modulated light beams onto said fourth photoreceptor to simultaneously expose a full scan line.

10. The full color xerographic line printer according to claim 9 wherein said polarization beam separating means is a multiple layer film polarized beam separator.

11. The full color xerographic line printer according to claim 9 wherein said polarization beam separating means is a prism polarized beam separator.

12. The full color xerographic line printer according to claim 9 wherein said polarization beam separating means is a beam splitter and two absorptive polarizers.

13. The full color xerographic line printer according to claim 9 wherein said wavelength separation means is a multiple layer film.

14. The full color xerographic line printer according to claim 9 wherein said wavelength separation means is a beam splitter and two wavelength selective bandpass filters.

15. A full color xerographic line printer comprising a photoreceptor, a first linear laser array for emitting first modulated light beams of a first wavelength and a first polarization state, a second linear laser array for emitting second modulated light beams of the first wavelength and a second polarization state orthogonal to said first polarization state, a third linear laser array for emitting third modulated light beams of a second wavelength, different from said first wavelength, and said first polarization state, and a fourth linear laser array for emitting fourth modulated light beams of the second wavelength and said second polarization state, imaging lens means for imaging said first, second, third and fourth modulated light beams onto said photoreceptor, and polarization beam separating means and wavelength separation means for separating said first modulated light beams onto a first region of said photoreceptor to simultaneously expose a full scan line, said second modulated light beams onto a second region of said photoreceptor to simultaneously expose a full scan line, said third modulated light beams onto a third region of said photoreceptor to simultaneously expose a full scan line, and said fourth modulated light beams onto a fourth region of said photoreceptor to simultaneously expose a full scan line.

16. The full color xerographic line printer according to claim 15 wherein said polarization beam separating means is a multiple layer film polarized beam separator.

17. The full color xerographic line printer according to claim 15 wherein said polarization beam separating means is a prism polarized beam separator.

18. The full color xerographic line printer according to claim 15 wherein said polarization beam separating means is a beam splitter and two absorptive polarizers.

19. The full color xerographic line printer according to claim 15 wherein said wavelength separation means is a multiple layer film.

20. The full color xerographic line printer according to claim 15 wherein said wavelength separation means is a beam splitter and two wavelength-selective bandpass filters.

21. A color xerographic line printer comprising at least two photoreceptors, at least two linear laser arrays for emitting at least two modulated light beams of either differing wavelengths or differing polarization states, imaging lens means for imaging said at least two modulated light beams onto said at least two photoreceptors, and polarization beam separating means and wavelength separation means for separating each of said at least two modulated light beams onto only one different photoreceptor to simultaneously expose a full scan line of said at least two photoreceptors.

22. A color xerographic line printer comprising a photoreceptor, at least two linear laser arrays for emitting at least two modulated light beams of either differing wavelengths or differing polarization states, imaging lens means for imaging said at least two modulated light beams onto said photoreceptor, and polarization beam separating means and wavelength separation means for separating each of said at least two modulated light beams onto a different area of said photoreceptor to simultaneously expose a full scan line.

* * * * *